US008188386B2

(12) United States Patent
Baier

(10) Patent No.: US 8,188,386 B2
(45) Date of Patent: May 29, 2012

(54) ROTARY PUSH-BUTTON CAPACITANCE SWITCH KNOB

(75) Inventor: Martin Baier, Ettlingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 302 days.

(21) Appl. No.: 12/695,195

(22) Filed: Jan. 28, 2010

(65) Prior Publication Data

US 2010/0194521 A1 Aug. 5, 2010

(30) Foreign Application Priority Data

Feb. 3, 2009 (DE) ..... 10 2009 008 192

(51) Int. Cl.
*H01H 9/00* (2006.01)

(52) U.S. Cl. ..... 200/4

(58) Field of Classification Search ..... 200/600, 200/4, 38 A; 338/25; 74/10 R
See application file for complete search history.

(56) References Cited

U.S. PATENT DOCUMENTS

| | | | | |
|---|---|---|---|---|
| 5,886,310 | A * | 3/1999 | Kataoka et al. | 200/14 |
| 5,920,131 | A | 7/1999 | Platt et al. | |
| 6,610,937 | B2 * | 8/2003 | Yamaguchi | 200/4 |
| 6,838,785 | B2 | 1/2005 | Schilling | |
| 6,867,379 | B2 | 3/2005 | Hayashi | |
| 7,368,673 | B2 * | 5/2008 | Sato | 200/5 R |
| 7,642,673 | B2 | 1/2010 | Baier | |
| 2004/0118664 | A1 * | 6/2004 | DePue et al. | 200/4 |

FOREIGN PATENT DOCUMENTS

| | | | |
|---|---|---|---|
| DE | 198 05 558 | A1 | 8/1999 |
| DE | 10 2007 035 564 | A1 | 1/2009 |
| EP | 0 366 445 | A2 | 5/1990 |
| EP | 1 655 516 | A2 | 5/2006 |

OTHER PUBLICATIONS

European Search Report dated Jun. 6, 2011 of corresponding European Application No. 10 15 0836.4.
German Office Action for German Application No. 10 2009 008 192.5.

* cited by examiner

*Primary Examiner* — Vanessa Girardi
(74) *Attorney, Agent, or Firm* — Alston & Bird LLP

(57) ABSTRACT

An operating device for an electrical appliance has a control panel and an operating element for rotary actuation arranged thereon and a controller, wherein said operating element is mounted in a receptacle arranged behind said control panel and comprises on a front a touch-sensitive switch with a sensor element being connected electrically conductively to said controller. Said operating device comprises a retraction device for retracting said operating element into its recessed position in said receptacle by pressing. Said retraction device is configured in such a way that said knob can only be retracted into its recessed position in a single retraction rotational position, said touch-sensitive switch being deactivated by said controller in said retraction rotational position.

12 Claims, 1 Drawing Sheet

ROTARY PUSH-BUTTON CAPACITANCE SWITCH KNOB

CROSS REFERENCE TO RELATED APPLICATIONS

This application claims priority to German Application Number 10 2009 008 192.5, filed on Feb. 3, 2009, the contents of which are incorporated by reference.

FIELD OF THE INVENTION

The invention generally relates to an operating device for an electrical appliance and to a corresponding operating method.

BACKGROUND OF THE INVENTION

It is known to configure an operating device with operating elements using rotary actuation to use "recessed rotary knobs". Normally, the operating elements are in this case recessed into the control panel. If they are needed, they may be made to pop out, generally by pressing them once, and may then be fully gripped. After initiating an operating process, or after use of the electrical appliance, they may be pushed back into their recessed position.

It is known from US Patent Publication 2007/0181410 A1 to provide a touch-sensitive switch on the front of an operating element for rotary actuation. In this way, further switching processes may be performed in addition to rotary actuation.

SUMMARY

A problem addressed by the invention is that of providing an above-mentioned operating device and an above-mentioned operating method which avoids problems of the prior art problems and with which a versatile, practical operating device and a corresponding operating method may be provided.

This problem is solved in one embodiment by an operating device having the features as claimed here and an associated operating method. Advantageous and preferred configurations of the invention are the subject matter of the further claims and are explained in greater detail below. Some of the features listed below are described only with reference to the operating device or only with reference to the operating method. However, they are intended to apply irrespectively both to the operating device and to the operating method. The wording of the claims is incorporated by express reference into the content of the description.

Provision is made for the operating device to comprise a control panel and an operating element arranged on the control panel, which operating element is configured for operation by rotary actuation, i.e., is a type of rotary knob. Moreover, the operating device comprises a controller, which is advantageously arranged behind the control panel, and in particular is also intended for other operating elements associated with the operating device or even the entire electrical appliance. The operating element is mounted in a receptacle arranged behind the control panel or on the back thereof. On the front it comprises a touch-sensitive switch with a sensor element, the touch-sensitive switch or the sensor element being connected electrically conductively to the controller. The operating device comprises a retraction device for the operating element, for retracting it substantially into its recessed position in the receptacle by pressing it.

According to one embodiment of the invention, the retraction device is configured in such a way that the operating element or the rotary knob can be retracted into its recessed position in just one rotational position, namely the "retraction rotational position". In this retraction rotational position the touch-sensitive switch is then deactivated by the controller or is not actuated and is ignored.

Thus the invention makes it possible for a switching process associated with pressing on or touching the front not to be triggered when the operating element is pressed, whether to retract it into the recessed position or pop it out, if an operator's finger used for this purposes touches the touch-sensitive switch or the sensor element. Thus, in this retraction rotational position no switching function is then triggered by the controller.

By limiting the possibility of retracting the operating element into the recessed position to just the one rotational position, it is also sufficient for the touch-sensitive switch to be deactivated in this position. If this retraction rotational position is advantageously an OFF position of the operating device or of the operating element and of a switching device or angle sensor contacted by the operating element, then, in general, a selection function is not provided in this position anyway, nor is a power or function level set. It may thus be provided that, in all the other rotational positions, the operating element cannot be pressed in at all and, since an operator is then aware of this, and there is actually no risk of unintentional touching of the front of the operating element.

In one configuration of the invention, the touch-sensitive switch or the sensor element structurally mainly forming the touch-sensitive switch is an electrically conductive surface, which is fixed or provided on the front of the operating element. In this respect, it is possible for the touch-sensitive switch or the sensor element to be exposed towards the outside for direct electrical contact between an operator's applied finger and the sensor element. Alternatively, in order to avoid insulation problems and to meet safety regulations, the touch-sensitive switch or its sensor element may be electrically insulated towards the front, i.e., towards the outside. This may be accomplished, for example by means of an insulating plastics layer, a coating, an adhesive film or the like. The sensor element may in itself, for example, take the form of a metallic surface, either in the form of a coating or in the form of an adhesively bonded or otherwise fixed small metal plate. It may for example also be incorporated or injection-molded into a rotary knob configured as the operating element.

The operating element comprises an electrically conductive connection passing through to the controller, which connection also passes through the retraction device or is guided there-along. At least partially electrically conductive spring elements may be provided for this purpose, advantageously a metallic helical spring. A spring may in particular be used as a functional part of the retraction device. An elongate and electrically conductive spring may be provided for example, which is advantageously configured as a helical spring, and which, in addition to a pop-out spring conventionally provided in such a retraction device, provides further electrical contacting of this pop-out spring with the stated switching device or angle sensor. To this end, a shaft of the switching device is advantageously electrically conductive, with a pick-off inside the switching device. The stated contact spring and the pop-out spring of the retraction device may be connected or coupled by an electrically conductive connecting element. Moreover, the pop-out spring, which has to be pressed in any event directly or indirectly against the operating element, may be connected electrically conductively to the sensor element or by means of capacitive signal transmission. It is even possible here to prefabricate sensor element and pop-out spring as a structural unit and then to install them in a rotary knob, in particular by injection molding as stated above.

In a further embodiment of the invention, the retraction device may comprise a telescopic sleeve, which is connected to the operating element, and a telescopic tube, which is seated on a pivot pin or a rotary shaft of the switching device. The telescopic sleeve extends over the telescopic tube, the two parts being coupled together by means of a latching mechanism. The telescopic tube is braced relative to the telescopic sleeve with a compressed pop-out spring, which as described above may rest against the sensor element or contact the latter electrically.

In one configuration of the invention, the telescopic tube may be electrically insulating, in particular it may consist of plastics, as preferably may be the telescopic sleeve. In an alternative embodiment of the invention, at least the telescopic tube, which is pushed directly onto the rotary shaft of the switching device, may be electrically conductive or made of metal and connected electrically conductively with the sensor element. As described above, a pop-out spring may serve for this purpose. Alternatively, the telescopic sleeve may be of electrically conductive construction and be connected on the one hand to the sensor element and on the other hand electrically conductively to the telescopic tube.

One embodiment of the sensor element is advantageously such that it is at a distance of a few millimeters from a side edge. The purpose of this is to ensure that, on normal turning of the rotary knob for operation, the sensor element is not inadvertently touched by a protruding finger or a protruding finger tip. At the same time, the sensor element should of course not be so small that it cannot be readily found by a finger. Advantageously, it may in this respect have a diameter amounting to approximately half the diameter of the front. It must also be ensured that, if the operating element otherwise comprises metallic parts on the outside or is at least partially electrically conductive, no bridge to the sensor element can here be formed.

In a still further embodiment of the invention, the controller may also recognize when the process of pressing in or recessing the operating element is started. Then the sensor element could, as it were, thereby be deactivated. However a possibly disadvantageous feature of this is that the sensor element has firstly to be touched on pressing in before pressing in actually takes place, such that such a measure is possibly somewhat too late.

In a still further embodiment of the invention, the operating element may be illuminated, as is known for example from German patent application DE 10 2009 006 434 A.

These and further features follow not only from the claims but also from the description and the drawings, the individual features being realized in each case alone or several together in the form of sub-combinations in an embodiment of the invention and in other fields and may constitute advantageous, per se protectable embodiments, for which protection is here claimed. Subdivision of the application into individual sections and intermediate headings does not limit the general applicability of the statements made thereunder.

BRIEF DESCRIPTION OF THE DRAWINGS

Exemplary embodiments of the invention are illustrated schematically in the drawings and explained in more detail below. In the drawings.

DETAILED DESCRIPTION OF THE EXEMPLARY EMBODIMENTS

Figure 1:
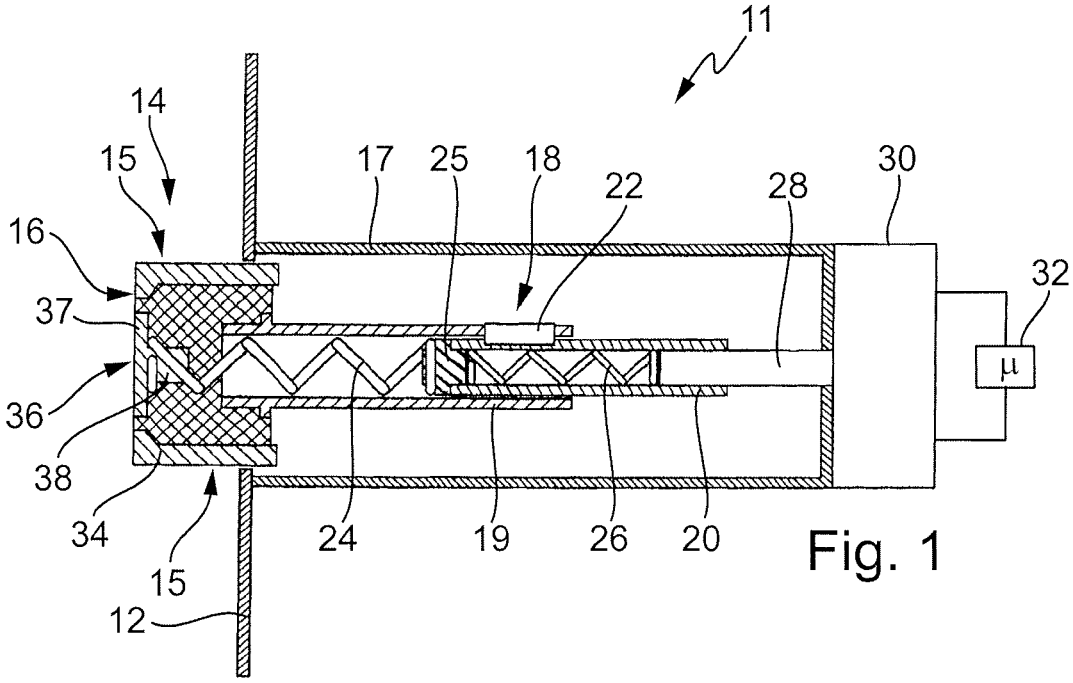
FIG. 1 shows a lateral section through an operating device according to the invention with a retraction device for an operating element and a touch-sensitive switch on the front of the operating element.

FIG. 1 is a highly schematic representation of an operating device 11 for rotary actuation and thus for rotary control of an electrical appliance, not shown in any more detail, for example an electric cooker, in the control panel 12 of which the operating device 11 is incorporated. The operating device 11 comprises an operating element 14 with a rotary knob 15 as a handle for operation by rotation, as is known per se. By pressing on the front 16 of the rotary knob 15, the latter may be retracted into a recessed position, as is explained in greater detail below, such that it is approximately flush with the control panel 12 or even deeper, and popped out again.

The operating element 14 is mounted in a receptacle 17 or the operating device 11 comprises such a receptacle, as is known per se. The receptacle 17 may here be roughly cup-like. In the receptacle 17 a retraction device 18 is provided for the operating element 14. The retraction device 18 may be configured in a substantially per se known manner with a telescopic sleeve 19, which is connected firmly to the operating element 14 or the rotary knob 15. A telescopic tube 20 extends in the telescopic sleeve 19, the two being connected by means of a latching mechanism 22. A pop-out spring 24 is provided in the telescopic sleeve 19, which automatically pops out the recessed operating element 14 as a result of pressure on the front 16. The pop-out spring 24, which is itself electrically conductive and to this end is advantageously made of metal, is connected or contacted by means of a likewise electrically conductive contact element 25, advantageously made of metal, with a contact spring 26. The contact spring 26 also advantageously consists of metal. It rests on the front of a rotary shaft 28, again preferably made of metal, of a switching device 30, which is advantageously a "code switch," for example a gray code switch, or alternatively an angle sensor. The switching device 30 may be mounted on the back of the receptacle 17. Within the switching device 30 electrical contacting is provided in a manner not shown to the rotary shaft 28, and then possibly onward to a controller 32. Thus the controller 32 is connected electrically to the pop-out spring 24.

The rotary knob 15 consists in detail of an outer cover 34, for example of metal or plastics material. On the front 16 a touch-sensitive switch 36 is provided, advantageously with a shape or surface corresponding to the cross-section of the rotary knob 15, and having a circular cross-section, as a general rule. The touch-sensitive switch 36 comprises a sensor element 37, which here is present in the form of a metal plate incorporated or integrated into the rotary knob. Electrical contacting of the sensor element 37 is effected by a contact part 38 provided on the back of the sensor element 37, which contact part 38 is connected mechanically to the pop-out spring 24, which may be slipped on in an electrically conductive manner. Sensor element 37 together with contact part 38, pop-out spring 24 and outer cover 34 may be produced or connected by encapsulating the corresponding parts by injection molding. The pop-out spring 24 may likewise be co-injection molded in. Alternatively, the contact part 38 may protrude so far out of the rotary knob 15, and in particular also serve in mechanical connection with the telescopic sleeve 19, that the pop-out spring 24 may rest in electrically contacting manner thereon. Likewise, the telescopic sleeve 19 may or may not be injection molded in.

Not shown in FIG. 1, but readily achieved by a person skilled in the art, is configuration of the retraction device 18 and of the latching mechanism 22 in such a way that the rotary knob 15 or the operating element 14 may be pressed-in in just one rotational position, namely the retraction rotational position. Since the switching device 30 is otherwise connected to the controller 32, the controller 32 thus being informed in particular about the respective rotational position, the controller 32 may deactivate the touch-sensitive switch 36 or not use any switching signals which may have been received therefrom, in the retraction rotational position, which advantageously corresponds to an off position.

The touch-sensitive switch 36 may, as explained for example in the above-stated US 2007/0181410 A1, be a capacitive touch-sensitive switch. It may then be ensured that the front of the sensor element 37 is electrically conductive for direct contact with an operator's finger to trigger switching. However, this does not have to be the case, in particular the sensor element 37 may also be insulated, for example, to comply with safety regulations. Moreover, a single, continuous surface may also be desired for the front 16 for visual reasons, for example formed by a coating or a plastics part.

Figure 2:
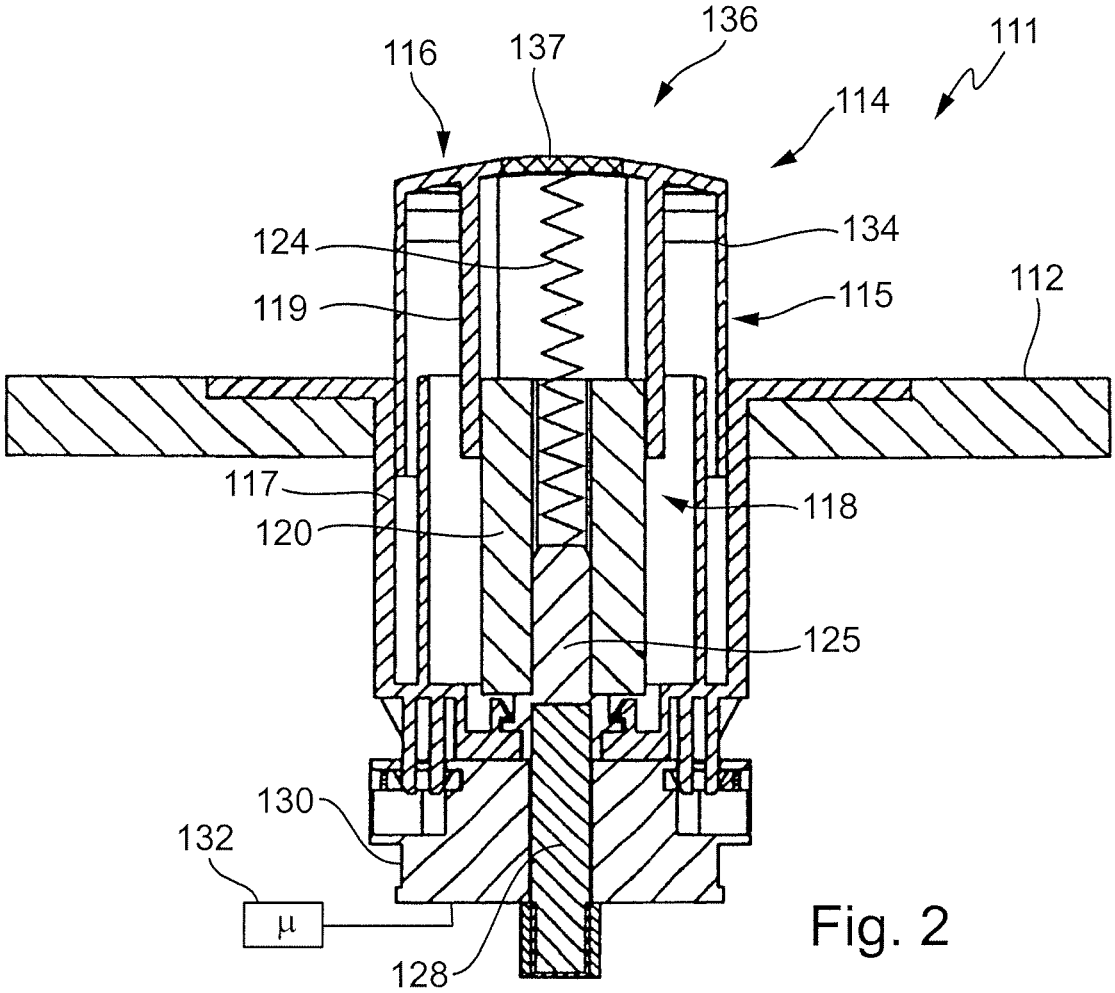
FIG. 2 shows an alternative embodiment of the operating device similar to FIG. 1.

FIG. 2 shows, as a modification of the operating device 11 of FIG. 1, an operating device 111 with control panel 112, which again comprises an operating element 114, which is formed by a rotary knob 115. On the front 116 thereof, a touch-sensitive switch 136 is also provided, which comprises as capacitive touch-sensitive switch a corresponding sensor element 137 inserted into the rotary knob 115.

In this case, a receptacle 117 is again of cup-like construction, with a retraction device 118 not described in any greater detail. The retraction device 118 again comprises a telescopic sleeve 119 and a telescopic tube 120. The telescopic sleeve 119 is here constructed in one piece with the rotary knob 115. The telescopic tube 120 is here seated, by means of a contact element 125 of different construction, which advantageously consists of metal, on a pivot pin 128 of a switching device 130, which is again connected with a controller 132. Moreover, the retraction device 118 comprises just one pop-out spring 124, which is connected electrically conductively to the sensor element 137, and no contact spring corresponding to FIG. 1. Electrical contacting proceeds from the pop-out spring 124 via the electrically conductive contact element 125 to the again electrically conductive pivot pin 128, which comprises a corresponding electrical pick-off in the switching device 130.

FIG. 2 thus makes it clear that it is possible both to configure a rotary knob 115 somewhat differently than according to FIG. 1 and also to replace the contact spring 26 according to FIG. 1 with a somewhat differently configured contact element 125. A latching mechanism (not shown in FIG. 2) again ensures that there is just one retraction rotational position for the operating element 114, and that this is the "off" position. Such a latching mechanism does not have to be provided between telescopic sleeve 119 and telescopic tube 120, but rather may also be provided at another location on the receptacle 117. For example, it may interact directly with an outer cover 134 of the rotary knob 115.

The invention claimed is:

1. An operating device for an electrical appliance, wherein said operating device has a control panel, an operating element comprising a knob for operation by rotary actuation arranged on said control panel and a controller arranged behind said control panel, wherein a receptacle is arranged behind said control panel, said operating element mounted in said receptacle and comprising a touch-sensitive switch with a sensor element on a front of said knob, said touch-sensitive switch being electrically connected or in a manner capable of capacitive signal transmission with said controller, said operating device comprising a retraction device for retracting said operating element into a recessed position substantially in said receptacle in response to pressing said knob, wherein said retraction device is configured in such a way that said knob is retractable into said recessed position in only one retraction rotational position, wherein said touch-sensitive switch is configured to be deactivated by said controller in said retraction rotational position.

2. The operating device as claimed in claim 1, wherein said touch-sensitive switch or said sensor element are exposed for contact with a user's finger.

3. The operating device as claimed in claim 1, wherein said touch-sensitive switch or said sensor element are electrically insulated towards said front.

4. The operating device as claimed in claim 1, wherein said touch-sensitive switch or its sensor element is an electrically conductive surface on said front of said operating element and comprises an electrically conductive connection to said controller passing through said operating element and said retraction device.

5. The operating device as claimed in claim 4, wherein said electrically conductive connection at least in part comprises a spring element, which is electrically conductive.

6. The operating device as claimed in claim 1, wherein said retraction device comprises an elongate, electrically conductive spring, said spring at the same time providing electrical contacting or an electrically conductive connection of said touch-sensitive switch with said controller.

7. The operating device as claimed in claim 6, wherein said spring is a helical spring.

8. The operating device as claimed in claim 1, wherein said retraction device comprises a telescopic sleeve and a telescopic tube seated on a pivot pin of a switching device, over which said telescopic tube said telescopic sleeve extends, said telescopic tube and said telescopic sleeve being coupled together by way of a latching mechanism and said telescopic tube being braced relative to said telescopic sleeve by a pop-out spring, which pop-out spring extends in a free region of said telescopic sleeve and forces said telescopic tube and said telescopic sleeve apart.

9. The operating device as claimed in claim 8, wherein said pop-out spring is in contact with said operating element.

10. The operating device as claimed in claim 8, wherein said pop-out spring is connected electrically conductively to said touch-sensitive switch or said sensor element as an electrically conductive connection.

11. The operating device as claimed in claim 8, wherein said telescopic tube is electrically insulating, and a contact spring extends inside said telescopic tube between an electrically conductive contact element to said pop-out spring and said electrically conductive pivot pin leading to said switching device, wherein said pivot pin of said switching device is connected electrically conductively to said controller.

12. An operating method for operating an operating device for an electrical appliance, wherein said operating device has a control panel, an operating element comprising a knob for operation by rotary actuation arranged on said control panel and a controller arranged behind said control panel, wherein a receptacle is arranged behind said control panel, said operating element mounted in said receptacle and comprising a touch-sensitive switch with a sensor element on a front of said knob, said touch-sensitive switch being electrically connected or in a manner capable of capacitive signal transmission with said controller, said operating device comprising a retraction device for retracting said operating element into a recessed position substantially in said receptacle in response to pressing said knob, wherein said retraction device is configured in such a way that said knob is retractable into said recessed position in only one retraction rotational position, wherein said touch-sensitive switch is configured to be deactivated by said controller in said retraction rotational position comprising the steps of:

detecting a rotational position of said operating element using a controller; and deactivating said touch-sensitive switch in said retraction rotational position, wherein said rotational position is the only rotational position in which said operating element may be retracted into said recessed position in said receptacle.

* * * * *